US006016938A

United States Patent [19]

Eichorst

[11] Patent Number: 6,016,938

[45] Date of Patent: Jan. 25, 2000

[54] SPRAY CAN TRIGGER SYSTEM

[76] Inventor: Lawrence G. Eichorst, 14159 Summit La., Waseca, Minn. 56093

[21] Appl. No.: 09/311,410

[22] Filed: May 13, 1999

[51] Int. Cl.[7] ..... B65D 83/18

[52] U.S. Cl. ..... 222/402.15; 222/473; 222/474

[58] Field of Search ..... 222/402.15, 472, 222/473, 474

[56] References Cited

U.S. PATENT DOCUMENTS

| | | | |
|---|---|---|---|
| 2,803,383 | 8/1957 | Dickman et al. | 222/473 |
| 3,112,849 | 12/1963 | Wallace | 222/402.15 |
| 4,040,543 | 8/1977 | Guillen | 222/402.15 |
| 4,098,436 | 7/1978 | Kohlbeck | 222/474 |
| 4,579,258 | 4/1986 | Brown et al. | 222/402.15 |
| 5,904,273 | 5/1999 | Aspacher et al. | 222/402.15 |

*Primary Examiner*—Joseph A. Kaufman
*Assistant Examiner*—Melvin Cartagena

[57] ABSTRACT

A spray can trigger system for actuating the spray head of an aerosol container such as a spray can. The spray can trigger system includes a base for resting an aerosol container thereon. An elongate rod upwardly extends from the base. An elongate top member is coupled to the rod. The proximal end of a lever arm is pivotally coupled to the top member. A distal end of the lever arm is designed for positioning above a spray head of the aerosol container resting on the base. A handgrip is downwardly depended from the top member. A pivot extent is pivotally coupled to the handgrip and has an elongate trigger downwardly depending therefrom. A pull loop is upwardly extended from the pivot extent. The lever arm and the top member are extended through the pull loop.

6 Claims, 3 Drawing Sheets

2
27
26
23
21
11
25
22
36
32
35
34
33
10
24
20
38
29
31
28
30
19
12
13
14
18
15
2

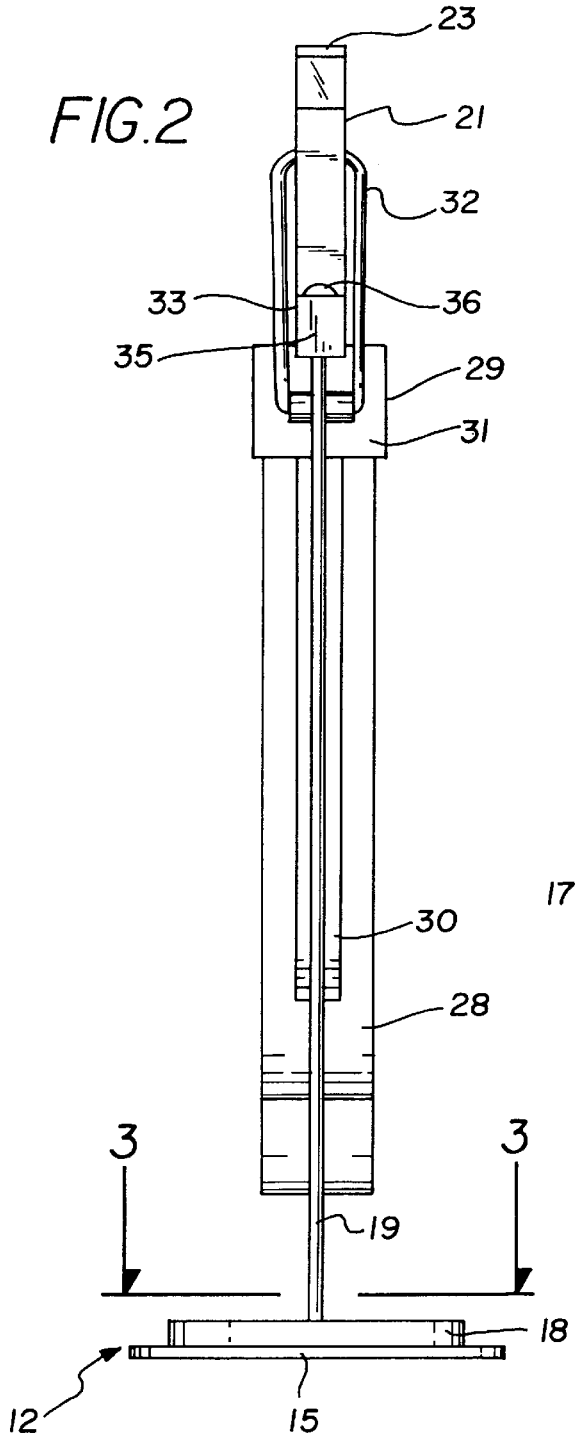
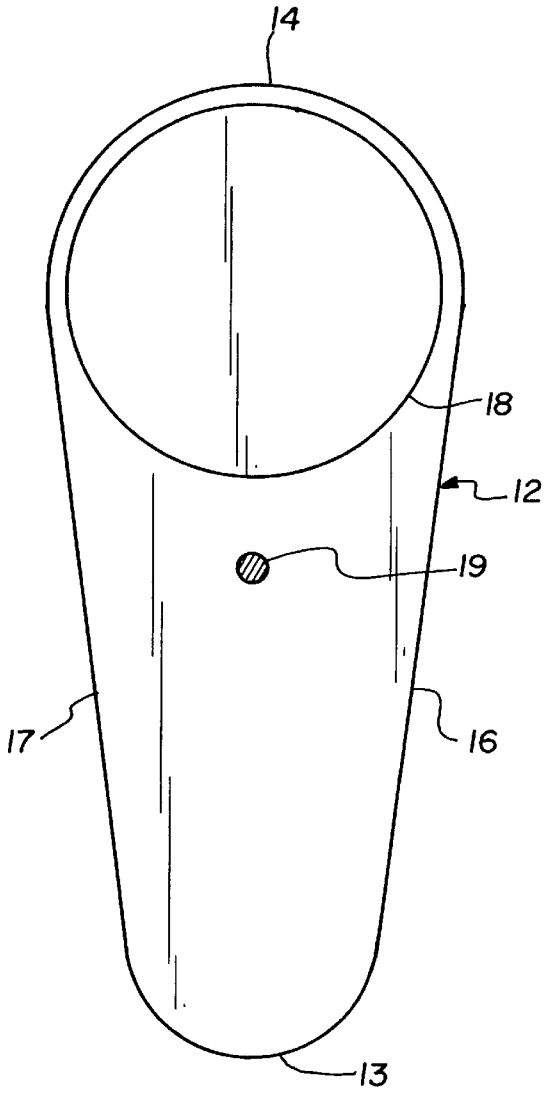
FIG.3

27
26
23
21
32

24
25
11
35
33
36
38
20
22
37
34
28
29
10
31
30
19
16
14
15
13
17

SPRAY CAN TRIGGER SYSTEM

BACKGROUND OF THE INVENTION

1. Field of the Invention

The present invention relates to actuating holders for aerosol containers and more particularly pertains to a new spray can trigger system for actuating the spray head of an aerosol container such as a spray can.

2. Description of the Prior Art

The use of actuating holders for aerosol containers is known in the prior art. More specifically, actuating holders for aerosol containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,579,258; 4,098,436; 3,734,357; 3,112,849; 2,803,383; and U.S. Pat. No. Des. 189,323.

While these devices fulfill their respective, particular objectives and requirements, the aforementioned patents do not disclose a new spray can trigger system. The inventive device includes a base for resting an aerosol container thereon. An elongate rod upwardly extends from the base. An elongate top member is coupled to the rod. The proximal end of a lever arm is pivotally coupled to the top member. A distal end of the lever arm is designed for positioning above a spray head of the aerosol container resting on the base. A handgrip is downwardly depended from the top member. A pivot extent is pivotally coupled to the handgrip and has an elongate trigger downwardly depending therefrom. A pull loop is upwardly extended from the pivot extent. The lever arm and the top member are extended through the pull loop.

In these respects, the spray can trigger system according to the present invention substantially departs from the conventional concepts and designs of the prior art, and in so doing provides an apparatus primarily developed for the purpose of actuating the spray head of an aerosol container such as a spray can.

SUMMARY OF THE INVENTION

In view of the foregoing disadvantages inherent in the known types of actuating holders for aerosol containers now present in the prior art, the present invention provides a new spray can trigger system construction wherein the same can be utilized for actuating the spray head of an aerosol container such as a spray can.

The general purpose of the present invention, which will be described subsequently in greater detail, is to provide a new spray can trigger system apparatus and method which has many of the advantages of the actuating holders for aerosol containers mentioned heretofore and many novel features that result in a new spray can trigger system which is not anticipated, rendered obvious, suggested, or even implied by any of the prior art actuating holders for aerosol containers, either alone or in any combination thereof.

To attain this, the present invention generally comprises a base for resting an aerosol container thereon. An elongate rod upwardly extends from the base. An elongate top member is coupled to the rod. The proximal end of a lever arm is pivotally coupled to the top member. A distal end of the lever arm is designed for positioning above a spray head of the aerosol container resting on the base. A handgrip is downwardly depended from the top member. A pivot extent is pivotally coupled to the handgrip and has an elongate trigger downwardly depending therefrom. A pull loop is upwardly extended from the pivot extent. The lever arm and the top member are extended through the pull loop.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new spray can trigger system apparatus and method which has many of the advantages of the actuating holders for aerosol containers mentioned heretofore and many novel features that result in a new spray can trigger system which is not anticipated, rendered obvious, suggested, or even implied by any of the prior art actuating holders for aerosol containers, either alone or in any combination thereof.

It is another object of the present invention to provide a new spray can trigger system which may be easily and efficiently manufactured and marketed.

It is a further object of the present invention to provide a new spray can trigger system which is of a durable and reliable construction.

An even further object of the present invention is to provide a new spray can trigger system which is susceptible of a low cost of manufacture with regard to both materials and labor, and which accordingly is then susceptible of low prices of sale to the consuming public, thereby making such spray can trigger system economically available to the buying public.

Still yet another object of the present invention is to provide a new spray can trigger system which provides in the apparatuses and methods of the prior art some of the advantages thereof, while simultaneously overcoming some of the disadvantages normally associated therewith.

Still another object of the present invention is to provide a new spray can trigger system for actuating the spray head of an aerosol container such as a spray can.

Yet another object of the present invention is to provide a new spray can trigger system which includes a base for resting an aerosol container thereon. An elongate rod upwardly extends from the base. An elongate top member is coupled to the rod. The proximal end of a lever arm is pivotally coupled to the top member. A distal end of the lever arm is designed for positioning above a spray head of the aerosol container resting on the base. A handgrip is downwardly depended from the top member. A pivot extent is pivotally coupled to the handgrip and has an elongate trigger downwardly depending therefrom. A pull loop is upwardly extended from the pivot extent. The lever arm and the top member are extended through the pull loop.

Still yet another object of the present invention is to provide a new spray can trigger system that helps relieve cramping to a user's hand when depressing the spray head of an aerosol container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a schematic distal end view of the present invention.

FIG. 3 is a schematic plan view of the base of the present invention taken from line 3—3 of FIG. 2.

DESCRIPTION OF THE PREFERRED EMBODIMENT

Figure 1:
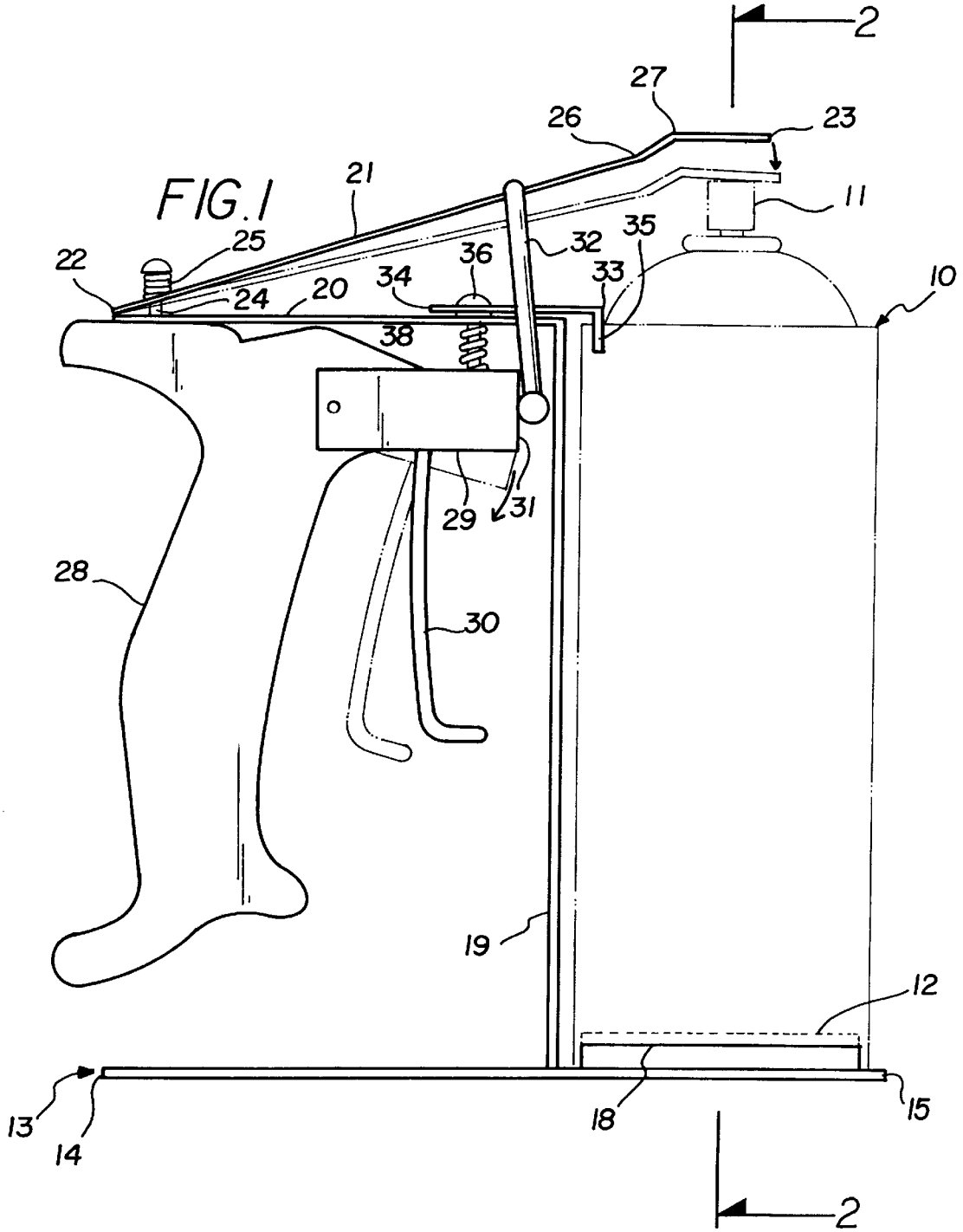
FIG. 1 is a schematic side view of a new spray can trigger system according to the present invention.
Figure 4:
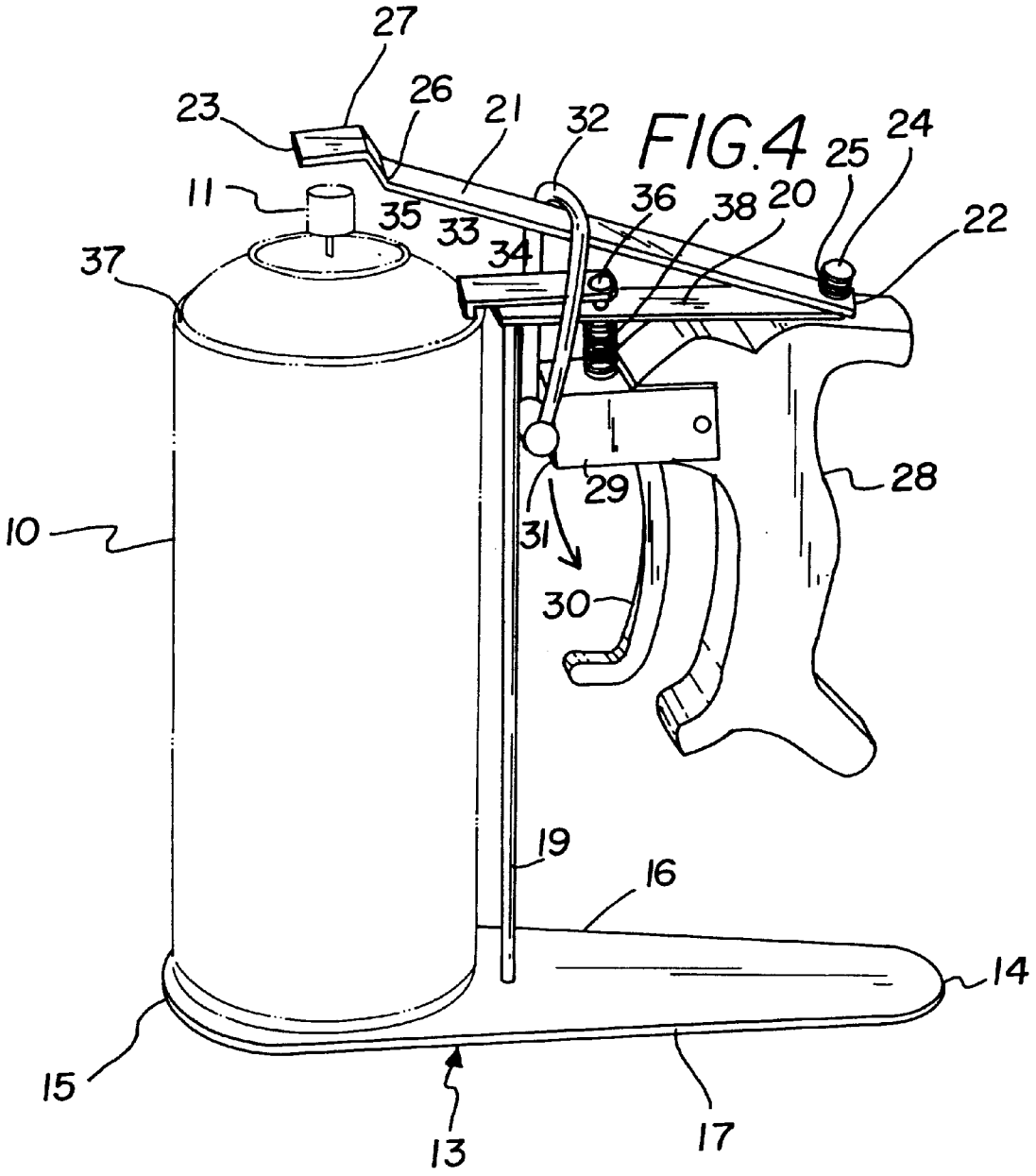
FIG. 4 is a schematic perspective view of the present invention.

With reference now to the drawings, and in particular to FIGS. 1 through 4 thereof, a new spray can trigger system embodying the principles and concepts of the present invention will be described.

As best illustrated in FIGS. 1 through 4, the spray can trigger system generally comprises a base for resting an aerosol container thereon. An elongate rod upwardly extends from the base. An elongate top member is coupled to the rod. The proximal end of a lever arm is pivotally coupled to the top member. A distal end of the lever arm is designed for positioning above a spray head of the aerosol container resting on the base. A handgrip is downwardly depended from the top member. A pivot extent is pivotally coupled to the handgrip and has an elongate trigger downwardly depending therefrom. A pull loop is upwardly extended from the pivot extent. The lever arm and the top member are extended through the pull loop.

In closer detail, the spray can trigger system is designed for use with a generally cylindrical aerosol container 10 having a top and a bottom, and a depressible spray head 11 mounted to the top of the aerosol container. Typically, the bottom of the aerosol container has a cavity 12 therein.

The trigger system is an assembly comprising a planar base 13 having arcuate proximal and distal ends 14,15, and a pair of straight sides 16,17 extending between the proximal and distal ends of the base. The distal end of the base has a radius of curvature greater than a radius of curvature of the proximal end of the base so that the sides of the base converge towards one another in a direction towards the proximal end of the base.

The bottom of the aerosol container is rested on the base adjacent the distal end of the base such that the aerosol container upwardly extends from the base. Preferably, the base has a generally disk-shaped stage 18 upwardly extending therefrom adjacent the distal end of the base. The cavity of the bottom of the aerosol container receives the stage of the base therein such that the stage holds the aerosol container in position on the base.

In an ideal illustrative embodiment, the base has a length defined between the proximal and distal ends of the base between about 7 ½ inches and about 8 inches to provide an optimal amount of stability to the trigger assembly when rested on a resting surface with the aerosol container resting on the base while also not being too long to hinder use of the trigger assembly in the hand of a user.

An elongate rod 19 upwardly extends from the base adjacent the stage such that the rod is positioned between the stage and the proximal end of the base. Preferably, the rod is extended substantially perpendicular to the base. The rod has opposite top and bottom ends with the bottom end of the rod being coupled to the base.

An elongate top member 20 is coupled to the top end of the rod and is extended substantially perpendicularly from the rod in a direction towards the proximal end of the base. The top member has a free end opposite the top end of the rod.

An elongate lever arm 21 is included having opposite proximal and distal ends 22,23. The proximal end of the lever arm is pivotally coupled to the free end of the top member by a mushroom-head pin 24 upwardly extending from the free end of the top member and through a hole at the proximal end of the lever arm. Preferably, the proximal end of the lever arm is biased towards the free end of the top member by a coiled spring 25 disposed around the mushroom-head pin between the head of the pin and the proximal end of the lever arm.

The distal end of the lever arm is extended upwardly and outwardly in a direction towards the distal end of the base from the proximal end of the lever arm. The distal end of the lever arm is positioned directly above the spray head of the aerosol container. In use, the distal end of the lever arm is designed for pivoting downwards towards the spray head of the aerosol container to depress the spray head to spray the contents of the aerosol container therefrom. Preferably, the lever arm has a pair of bends 26,27 located towards the distal end of the lever arm for making a more parallel contact between the distal end of the lever arm and the spray head of the aerosol container.

A handgrip 28 is downwardly depended and coupled to the top member adjacent the free end of the top member. In use, the handgrip is designed for grasping with the hand of a user to hold the trigger assembly.

A pivot extent 29 is pivotally coupled to an upper portion of the handgrip and extended from the handgrip towards the rod. The pivot extent is pivotable about an axis substantially perpendicular to the rod such that the pivot extent pivots in a plane substantially parallel to the rod.

An elongate trigger 30 is downwardly depended from the pivot extent and positioned between the handgrip and the rod. In use, the trigger is designed for squeezing with the hand of the user towards the handgrip to pivot the pivot extent downwards.

The pivot extent has a distal end 31 opposite the handgrip and located towards the rod. A generally annular pull loop 32 is upwardly extended from the distal end of the pivot extent. The pull loop has upper and lower portions with the lower portion of the being coupled to the distal end of the pivot extent. The lever arm and the top member is extended through the pull loop with the lever arm positioned directly beneath the upper portion of the pull loop. In use, pivoting downwards of the pivot extent by pulling on the trigger moves the pull loop downwards which in turn forces the distal end of the lever arm to move downwards to depress the spray head of the aerosol can.

A generally L-shaped retaining clip 33 is preferably included having an upper elongate portion 34 and an end portion 35 downwardly extending from the upper elongate portion of the retaining clip. The upper elongate portion is rotatably mounted to the top member adjacent the top end of the rod and above the pivot extent by another mushroom-head pin 36 upwardly extended from the pivot extent and extended through generally coaxial holes in the top member and upper elongate portion of the clip. This allows rotation of the retaining clip about the pin in a plane parallel to the top member.

The end portion of the retaining clip is positioned between the top end of the rod and the distal end of the base. In use, the end portion of the retaining clip is inserted into an annular lip 37 upwardly extending around the top of the aerosol container to hold the aerosol container between the base and the retaining clip. The rotatable mounting of the retaining clip providing a means for moving the retaining clip to release it from the lip of the aerosol container or to mount to a replacement spray container.

The retaining clip is preferably biased downwards to bias the end portion of the retaining clip down by a coiled spring 38 disposed about the mushroom head pin between the top member and the pivot extent to help securely hold the aerosol container between the retaining clip and the base.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An aerosol container spray head depressing system, comprising:

a base having proximal and distal ends, said base being adapted for resting an aerosol container thereon adjacent said distal end of said base;

an elongate rod upwardly extending from said base;

an elongate top member being coupled to said rod;

an elongate lever arm having opposite proximal and distal ends, said proximal end of said lever arm being pivotally coupled to said top member, said distal end of said lever arm being adapted for positioning above a spray head of the aerosol container resting on said base;

a handgrip being downwardly depended from said top member;

a pivot extent being pivotally coupled to said handgrip;

an elongate trigger being downwardly depended from said pivot extent; and a pull loop being upwardly extended from said pivot extent, said lever arm and said top member being extended through said pull loop.

2. The aerosol container spray head depressing system of claim 1, wherein said proximal and distal ends of said base are rounded and said base has a pair of straight sides extending between said proximal and distal ends of said base, wherein said distal end of said base has a radius of curvature greater than a radius of curvature of said proximal end of said base, and wherein said sides of said base converge towards one another in a direction towards said proximal end of said base.

3. The aerosol container spray head depressing system of claim 1, wherein said base has a stage upwardly extending therefrom adjacent said distal end of said base, said stage being adapted for extending into a cavity in a bottom of the aerosol container resting on said base.

4. The aerosol container spray head depressing system of claim 1, wherein said rod is extended substantially perpendicular to said base.

5. The aerosol container spray head depressing system of claim 1, further comprising a generally L-shaped retaining clip being rotatably mounted to said top member, said retaining clip having an end portion positioned between said rod and said distal end of said base, said end portion of said retaining clip being adapted for insertion into an annular lip upwardly extending around the top of the aerosol container resting on said base.

6. An aerosol container spray head depressing system, comprising:

a generally cylindrical aerosol container having a top and a bottom, and a depressible spray head mounted to said top of said aerosol container, the bottom of said aerosol container having a cavity therein;

a trigger assembly comprising:

a planar base having arcuate proximal and distal ends, and a pair of straight sides extending between said proximal and distal ends of said base;

said distal end of said base having a radius of curvature greater than a radius of curvature of said proximal end of said base, said sides of said base converging towards one another in a direction towards said proximal end of said base;

said bottom of said aerosol container being rested on said base adjacent said distal end of said base such that said aerosol container upwardly extends from said base;

said base having a generally disk-shaped upwardly extending stage adjacent said distal end of said base;

said cavity of said bottom of said aerosol container receiving said stage of said base therein;

an elongate rod upwardly extending from said base adjacent said stage such that said rod is positioned between said stage and said proximal end of said base;

said rod being extended substantially perpendicular to said base;

said rod having opposite top and bottom ends, said bottom end of said rod being coupled to said base;

an elongate top member being coupled to said top end of said rod and being extended substantially perpendicularly from said rod in a direction towards said proximal end of said base;

said top member having a free end opposite said top end of said rod;

an elongate lever arm having opposite proximal and distal ends, said proximal end of said lever arm being pivotally coupled to said free end of said top member;

said distal end of said lever arm being extended upwardly and outwardly in a direction towards said distal end of said base from said proximal end of said lever arm;

said distal end of said lever arm being positioned above said spray head of said aerosol container;

a handgrip being downwardly depended and coupled to said top member adjacent said free end of said top member;

a pivot extent being pivotally coupled to an upper portion of said handgrip and extended from the handgrip towards said rod;

an elongate trigger being downwardly depended from said pivot extent and positioned between said handgrip and said rod;

said pivot extent having a distal end opposite said handgrip and located towards said rod;

a pull loop being upwardly extended from said distal end of said pivot extent, said pull loop having upper and lower portions, said lower portion of said being coupled to said distal end of said pivot extent;

said lever arm and said top member being extended through said pull loop, said lever arm being positioned beneath said upper portion of said pull loop;

a generally L-shaped retaining clip having an upper elongate portion and an end portion downwardly extending from said upper elongate portion of said retaining clip;

said upper elongate portion being rotatably mounted to said top member adjacent said top end of said rod and above said pivot extent;

said end portion of said retaining clip being position between said top end of said rod and said distal end of said base; and said end portion of said retaining clip being inserted into an annular lip upwardly extending around the top of the aerosol container to hold the aerosol container between said base and said retaining clip.

* * * * *